US006817917B1

(12) United States Patent
Kado et al.

(10) Patent No.: US 6,817,917 B1
(45) Date of Patent: Nov. 16, 2004

(54) MANUFACTURING METHOD FOR A PLASMA DISPLAY PANEL WITH SUPERIOR LUMINESCENCE

(75) Inventors: Hiroyuki Kado, Osaka (JP); Kanako Miyashita, Moriguchi (JP); Naoki Kosugi, Kyoto (JP); Yasuhisa Ishikura, Katano (JP); Utaro Miyagawa, Nagaokakyo (JP); Shigeo Haruki, Nagaokakyo (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 09/744,382

(22) PCT Filed: May 18, 2000

(86) PCT No.: PCT/JP00/03171

§ 371 (c)(1),
(2), (4) Date: Jan. 23, 2001

(87) PCT Pub. No.: WO00/74100

PCT Pub. Date: Dec. 7, 2000

(30) Foreign Application Priority Data

May 28, 1999 (JP) ..... 11-149896
Aug. 20, 1999 (JP) ..... 11-233818
Nov. 30, 1999 (JP) ..... 11-339199

(51) Int. Cl.[7] ..... H01J 9/26
(52) U.S. Cl. ..... 445/25
(58) Field of Search ..... 445/24, 25, 40–42, 445/70; 313/485–487, 495–497

(56) References Cited

U.S. PATENT DOCUMENTS 5,754,003 A * 5/1998 Murai et al. ..... 313/582
5,846,110 A * 12/1998 Kanagu et al. ..... 445/25
5,938,494 A * 8/1999 Betsui et al. ..... 445/24
5,951,350 A * 9/1999 Aoki et al. ..... 445/24
6,030,267 A * 2/2000 Browning ..... 445/25
6,109,994 A * 8/2000 Cho et al. ..... 445/25
6,129,603 A * 10/2000 Sun et al. ..... 445/25
6,236,159 B1 * 5/2001 Inoue et al. ..... 313/582
6,353,288 B1 * 3/2002 Asano et al. ..... 313/582
6,439,943 B1 * 8/2002 Aoki et al. ..... 445/24

FOREIGN PATENT DOCUMENTS

| | | |
|---|---|---|
| EP | 921172 | 6/1999 |
| JP | S61-42837 | 8/1984 |
| JP | 02-216732 | 8/1990 |
| JP | 3272544 | 12/1991 |
| JP | 04-342925 | 11/1992 |
| JP | 05-211031 | 8/1993 |
| JP | 5211031 | 8/1993 |
| JP | 05-234512 | 9/1993 |
| JP | 6196094 | 7/1994 |
| JP | 09-017343 | 1/1997 |
| JP | 9063488 | 3/1997 |
| JP | 1040822 | 2/1998 |
| JP | 10326572 | 12/1998 |
| JP | 11-040065 | 2/1999 |
| JP | 11140437 | 5/1999 |
| JP | 11144625 | 5/1999 |

* cited by examiner

*Primary Examiner*—Joseph Williams
*Assistant Examiner*—Dalei Dong

(57) ABSTRACT

A PDP operates with high luminous efficiency and reproduces colors faithfully. When sealing the PDP, a sealant layer (15) is formed around the facing main surfaces of the front panel (10) and the back panel (20). Protrusions (16) and depressions (17) are formed in parts of the sealant layer (15) to produce gaps (18) at the periphery of the PDP. The heating performed to soften the sealant layer (15) is conducted in a dry gas atmosphere. As a result, moisture passes from the inner space of the PDP through the gaps (18) and out of the PDP, thereby reducing the heat deterioration in the blue phosphor layer (25).

7 Claims, 13 Drawing Sheets

AMOUNT OF GENERATED STEAM(RELATIVE VALUE)
0
100
200
300
400
500
600
700
800
900
1000
HEATING TEMPERATURE(℃)

MANUFACTURING METHOD FOR A PLASMA DISPLAY PANEL WITH SUPERIOR LUMINESCENCE

TECHNICAL FIELD

The present invention relates to a manufacturing method for a plasma display panel used as a display for a color television set or the like.

BACKGROUND ART

In recent years, Plasma Display Panel (hereafter referred to as PDPs) have attracted attention as large-scale, thin, lightweight displays for use in computers and televisions. This has resulted in an increasing demand for high-definition PDPs.

FIG. 16 is a simplified sectional view showing an example of a typical alternating current (AC) type PDP.

In the figure, display electrodes 102 are formed on a front glass substrate 101. These are then covered by a dielectric glass layer 103 and a protective layer 104 made of magnesium oxide (MgO) (see, for example, Japanese Laid-Open Patent No. 5-342991).

Address electrodes 106 and barrier ribs 107 are formed on a back glass substrate 105. Phosphor layers 110 to 112 of respective colors (red, green, and blue) are formed in spaces between the barrier ribs 107.

The front glass substrate 101 is then placed on the barrier ribs 107 on the back glass substrate 105. A discharge gas is supplied into the spaces between the substrates 101 and 105 to form discharge spaces 109.

In the above PDP, vacuum ultraviolet rays (their wavelength is mainly at 147 nm) are emitted as electric discharges occur in the discharge spaces 109. The phosphor layers 110 to 112 of respective colors are excited by the emitted vacuum ultraviolet rays, resulting in color display.

The following is an explanation of a manufacturing method for the above PDP.

The display electrodes 102 are formed by applying a silver paste to the surface of the front glass substrate 101, and baking the applied silver paste. The dielectric layer 103 is formed by applying a dielectric glass paste to the surface of the layers, and baking the applied dielectric glass paste. The protective layer 104 is then formed on the dielectric glass layer 103.

The address electrodes 106 are formed by applying a silver paste to the surface of the back glass substrate 105, and baking the applied silver paste. The barrier ribs 107 are formed by applying a glass paste to the surface of the layers with a certain pitch, and baking the applied glass paste. The phosphor layers 110 to 112 are formed by applying pastes of phosphors of respective colors to the spaces between the barrier ribs 107, and baking the applied pastes at around 500° C. to remove resin and other elements from the pastes.

After the phosphors are baked, a sealing glass frit is applied to a peripheral region of the front glass substrate 101 or of the back glass substrate 105, and the applied sealing glass frit is baked at around 350° C. to remove resin and other elements from the applied sealing glass frit thereby forming a glass sealant layer. (Frit Pre-baking Process)

The front glass substrate 101 and the back glass substrate 105 are put together in such a manner that the display electrodes 102 and the address electrodes 106 face each other at right angles. The substrates are then sealed by heating them to a temperature (around 450° C.) higher than a softening point of the glass sealant layer. (Sealing Process).

The panel composed of the sealed substrates is then heated to a temperature of around 350° C. while air is being removed from an inner space formed between the substrates (the space is formed between the front glass substrate and the back glass substrate, and the phosphor layers are exposed to the space). (Exhausting Process). After the exhausting process is complete, the discharge gas is supplied to the inner space at a certain pressure (typically, in a range of $4\times10^4$ Pa to $7\times10^4$ Pa).

One issue is how to improve the luminance and the color reproduction of the PDP manufactured as above.

In view of the above issue, the phosphors used to form the phosphor layers have been improved. However, it is also desirable to consider improving the luminance and the color reproduction by improving the manufacturing process of the PDP.

DISCLOSURE OF THE INVENTION

The object of the present invention is to provide a PDP which exhibits high light-emitting efficiency and superior color reproduction. The above object can be achieved by the following. In the process where a sealant layer is formed on at least one of peripheral regions of the facing sides of the front panel and the back panel, a shape of the sealant layer is set so that at least one gap is provided between the panels. The gaps serve as passages between the inner space of the PDP and the outside of the PDP.

As a specific way to provide at least one gap between the peripheral regions of the panels when the panels are placed facing each other, the sealant layer is formed so as to have at least one protrusion or one depression. Alternatively, a sealant layer is formed around one of the peripheral regions of the substrates, and another sealant layer is formed at least on one part of the other one of the peripheral regions of the substrates.

The following is an explanation of the effects produced by the present invention.

During a manufacturing process of a PDP, blue phosphors are deteriorated by heat as the phosphor layers which have been formed are heated in the sealing process. This lowers the intensity and the chromaticity of the emitted light. The inventors of the present invention have found that this heat deterioration in the blue phosphors is more likely to occur when the phosphor layers are heated in an atmosphere that contains a large amount of moisture, and is less likely to occur when the phosphor layers are heated in an atmosphere that contains little moisture.

Here, with a conventional method for manufacturing a typical PDP, moisture absorbed by the substrates (especially by the MgO protective layer) evaporates into the inner space when a sealant layer placed between the front substrate and the back substrate is heated. As the moisture is trapped within the inner space, the phosphors are exposed to an atmosphere containing a large amount of moisture at a high temperature. In such a situation, the phosphors are easily deteriorated by heat.

In contrast, according to the PDP manufacturing method of the present invention, gaps through which a gas can circulate are maintained at the periphery of the PDP until the sealant layer is heated to a temperature of a softening point of the sealant layer. Therefore, the moisture that has been evaporated into the inner space can escape, instead of being trapped within the inner space. This prevents the phosphors from being exposed to an atmosphere containing a large amount of moisture.

As described above, the heat deterioration in the phosphors (especially in the blue phosphors) during the sealing process can be prevented in accordance with the PDP manufacturing method of the present invention.

Here, if the sealing process in which a sealant layer is heated is carried out in a dry gas atmosphere or in a decreased pressure atmosphere, the heat deterioration in the phosphors can be more effectively prevented.

Here, 'dry gas' refers to a gas containing steam with a lower partial pressure than the typical partial pressure. It is especially preferable to use air that has been subjected to a drying process (dry air).

It is desirable that the partial pressure of the steam in the dry gas atmosphere is set at 10 Torr (1300 Pa) or lower, and more preferably at 5 Torr (650 Pa) or lower, or at 1 Torr (130 Pa) or lower. It is desirable that the dew-point temperature of the dry gas is set at 12° C. or lower, and more preferably at 0° C. or lower, or at −20° C. or lower.

It is preferable to carry out not only the sealing process but also the baking process of the phosphors, the pre-baking process of the sealant, and the exhausting process in the dry gas atmosphere, so that the heat deterioration in the phosphors during these processes can also be prevented. This greatly improves light-emitting characteristics of the blue phosphors used in the PDP.

By manufacturing a PDP in accordance with the method of the present invention, the chromaticity coordinate y (CIE color specification) of light emitted from blue cells of the PDP when only the blue cells emit light, or of light emitted when the blue phosphors are excited by vacuum ultraviolet rays can be made 0.08 or lower. Moreover, the peak wavelength of a spectrum of light emitted from blue cells of the PDP when only the blue cells emit light can be made 455 nm or lower.

By improving the chromaticity of emitted light of the blue phosphors, color reproduction of the PDP is also improved. The color temperature in the white balance, that is, the color temperature of the emitted light when all cells emit light on the same power condition can be made 9000K or higher.

DESCRIPTION OF THE PREFERRED EMBODIMENTS

First Embodiment

Figure 1:
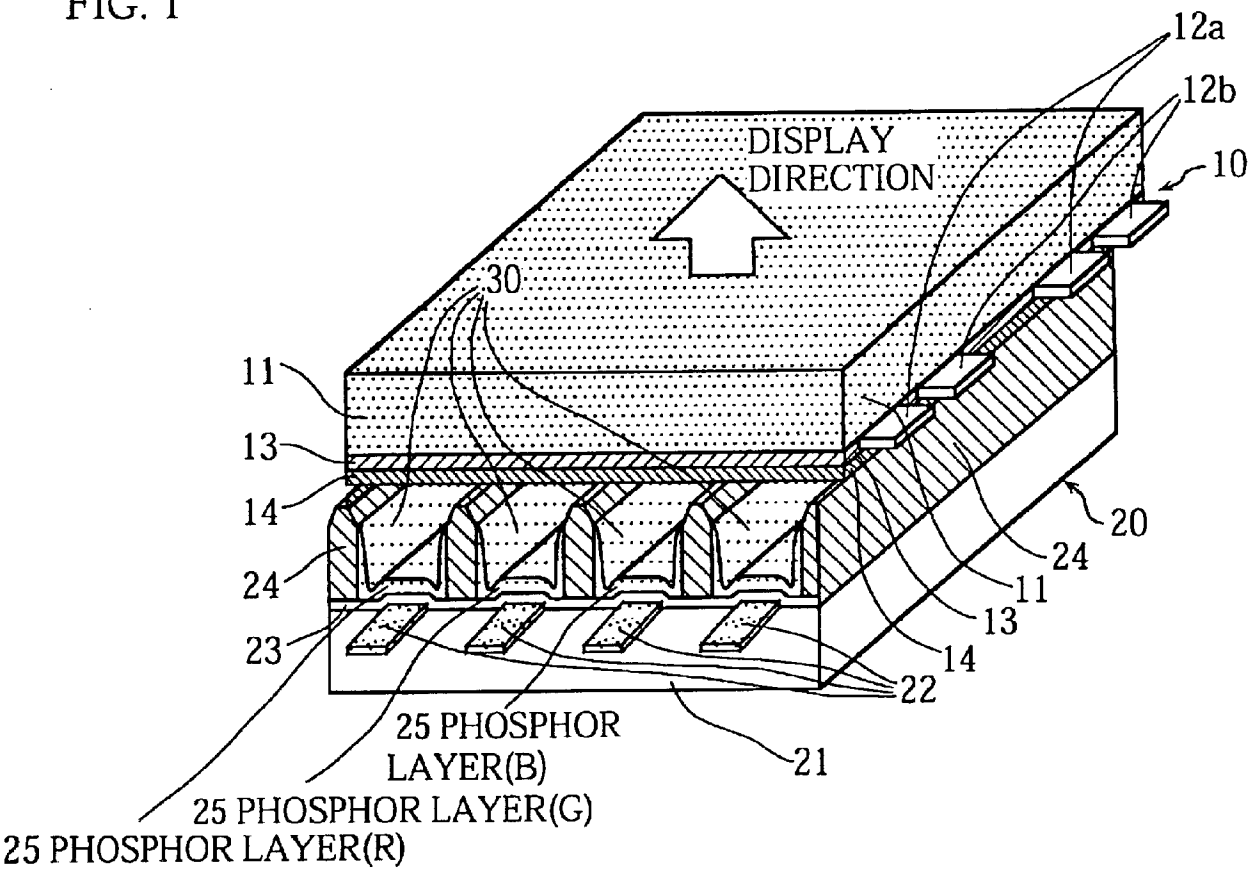
FIG. 1 is a sectional view showing the essential components of an AC-type discharge PDP relating to the present embodiments.

FIG. 1 is a sectional view showing the essential components of an AC-type discharge PDP relating to the present embodiment. The figure partly shows a display area located at the center of the PDP.

This PDP is constructed of a front panel 10 and a back panel 20. The front panel 10 is formed from a front glass substrate 11, on whose inward surface display electrodes 12 (formed of scanning electrodes 12*a* and sustaining electrodes. 12*b*), a dielectric layer 13 and a protective layer 14 are formed. The back panel 20 is formed from a back glass substrate 21, on whose inward surface address electrodes 22 and a dielectric layer 23 are formed. The front plate 10 and the back plate 20 are arranged in parallel leaving a space between them, with the display electrodes 12 and the address electrodes 22 facing each other. The space between the front panel 10 and the back panel 20 is divided into discharge spaces 30 by constructing barrier ribs 24, that run in uniform parallel lines. A discharge gas is introduced into these discharge spaces 30.

In the discharge spaces 30, phosphor layers 25 are formed on the back panel 20 so that each discharge space 30 has a phosphor layer of one color out of red, green, and blue and that the phosphor layers 25 are repeatedly arranged in said order of the colors.

The display electrodes 12 and the address electrodes 22 are both arranged in uniform parallel lines, the display electrodes 12 being placed at right angles to the barrier ribs 24, and the address electrodes 22 being parallel with the barrier ribs 24. The panel composed of the front panel 10 and the back panel 20 has a structure in which the points where the display panel electrodes 12 and the address electrodes 22 intersect to form cells to emit red, green and blue light.

It should be noted that the display electrodes 12 are arranged here in uniform parallel lines, however, the display electrodes may be formed as island electrodes, or may be formed with vents. The barrier ribs 24 also do not need to be formed as stripes and may instead be formed as parallel crosses.

The PDP is driven as follows. An address discharge pulse is applied to the scanning electrodes 12*a* and the address electrodes 22 by a driving circuit (not illustrated), so that wall charge accumulates in the cells that are to be ignited. Following this, a sustaining discharge pulse is applied between the pairs of the display electrodes 12*a* and 12*b* so that sustained discharge occurs in the cells that have accumulated wall charges. The above process is repeated to ignite the cells and produce a luminescent display.

The address electrodes 22 are metal electrodes (for example, silver electrodes or Cr—Cu—Cr (chromiumcopper-chromium) electrodes). The display electrodes 12 may be constructed by covering a wide transparent electrode made of an electrically conductive metal oxide such as ITO, $SnO_2$ or ZnO with a narrow bus electrode (such as, a silver electrode or a Cr—Cu—Cr electrode). This electrode structure is preferable since it provides a wide discharge area within a cell. However, the display electrodes 12 may also be formed from metal electrodes in the same way as the address electrodes 22.

The dielectric layer 13 is formed from a dielectric substance which is applied so that it covers the entire surface of the front glass substrate 11 on which the display electrodes 12 are arranged. Lead glass with a low melting point is typically used for this purpose, but bismuth glass with a low melting point or a laminate of these two types of glass may also be used.

The protective layer 14 is a thin film made of magnesium oxide (MgO) covering the entire surface of the dielectric layer 13.

The dielectric layer 23 is formed from the same material as the dielectric layer 13, but the dielectric layer 23 also includes $TiO_2$ particles so that it functions as a visible light reflective layer as well.

The barrier ribs 24 are made of a glass material and project out with a certain pitch on the dielectric layer 23 in the back panel 20.

The following are the phosphors used to compose the phosphor layers 25 in the present embodiment:

blue phosphor $BaMgAl_{10}O_{17}$:Eu green phosphor $Zn_2SiO_4$:Mn red phosphor (YxGd1-x)$BO_3$:Eu The composition of these phosphors is basically the same as the conventional materials used in PDPs. However, compared with the conventional materials, the phosphors of the present embodiment produce better colors as the blue phosphor layers are less deteriorated by heat during the manufacturing of the PDP. That is to say, the chromaticity coordinate y of the light emitted from blue cells is small (that is, the peak wavelength of the emitted blue light is short), and the color reproduction range near the blue color is wide.

More specifically, in conventional typical PDPs, the chromaticity coordinate y (CIE color specification) of the light emitted from blue cells when only blue cells emit light is 0.085 or higher (the peak wavelength of the spectrum of the emitted light is 456 nm or higher), and the color temperature in the white balance without color correction is about 6,000K.

As a technique for improving the color temperature in the white balance, one technique makes the width of the blue cells (a pitch of the barrier ribs) larger than the width of the green cells or the red cells to increase the area of the blue cells relative to the green cells or the red cells. However, to set the color temperature at 7,000K or higher using this technique, the area of the blue cells needs to be at least about 1.3 times that of the red or green cells.

On the contrary, in the PDP of the present embodiment, the heat deterioration in blue phosphors during the manufacturing process of the PDP is reduced as described later. Accordingly, when only blue cells emit light, the chromaticity coordinate y of the light emitted from the blue cells is 0.08 or lower, and the peak wavelength of the spectrum of the emitted light is 455 nm or lower. Under these conditions, it is not necessary to make the area of blue cells larger to increase the color temperature to 9,000K or higher in the white balance without color correction. Also, depending on the conditions at manufacturing, it is also possible to decrease the chromaticity coordinate y even further, or increase the color temperature to around 10,000K in the white balance without color correction.

It should be noted that the following are explained in detail in later embodiments.

(1) A low chromaticity coordinate y of blue cells has a same effect as a short peak wavelength of the emitted blue light.

(2) The smaller the chromaticity coordinate y of the blue cells, the wider the color reproduction area.

(3) How the chromaticity coordinate y of the light emitted from blue cells is related to the color temperature in the white balance without color correction.

The present embodiment assumes that the present PDP is used for a 40-inch high definition TV, so that the thickness of the dielectric layer 13 is set at around 20 $\mu$m, and the thickness of the protective layer 14 at around 0.5 $\mu$m. Also, the height of the barrier ribs 24 is set in a range of 0.1 mm to 0.15 mm, the pitch of the barrier ribs in a range of 0.15 mm to 0.3 mm, and the thickness of each of the phosphor layers 25 in a range of 5 $\mu$m to 50 $\mu$m. The discharge gas to be introduced is Ne—Xe gas in which Xe constitutes 5% by volume. The charging pressure is set in a range of 500 Torr to 800 Torr ($6.5\times10^4$ Pa to $10.4\times10^4$ Pa).

Figure 2:
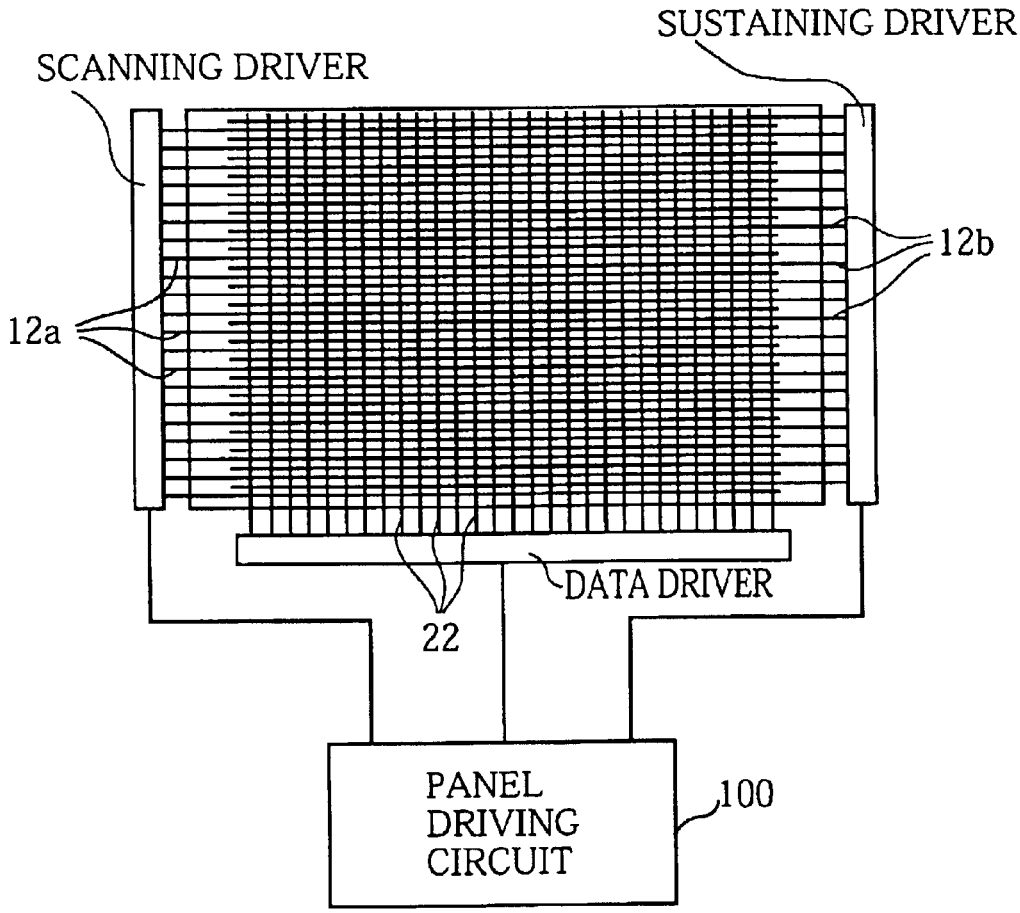
FIG. 2 shows a PDP display apparatus composed of the PDP shown in FIG. 1 and a driving circuit connected to the PDP.

The PDP is driven as follows. Various drivers and a panel driving circuit 100 are attached to the PDP as shown in FIG. 2. Power is supplied between the scanning electrodes 12*a* and the address electrodes 22 for the cells which are to be ignited, causing an address discharge. Following this, a pulse voltage is applied between the display electrodes 12*a* and 12*b* to cause a sustaining discharge. Discharge in the cells are accompanied by the emission of ultraviolet rays, which is converted into visible light by the phosphor layers 25. Igniting cells in this way enables images to be displayed.

Manufacturing Method for the PDP

The following is an explanation of a manufacturing method for the PDP with the above construction.

Manufacturing the Front Panel

The front panel 10 is manufactured in the following way. The display electrodes 12 are formed by applying a paste for silver electrodes onto the front glass substrate 11 using a screen-printing method and baking the applied paste. Then, the dielectric layer 13 is formed by applying a paste containing a lead glass material (composed for example of 70 wt. % of lead oxide (PbO), 15 wt. % of boron oxide ($B_2O_3$), and 15 wt. % of silicon oxide ($SiO_2$)) using a screen-printing method so as to cover the display electrodes 12 and baking the applied material. Finally, the protective layer 14 composing of magnesium oxide (MgO) is formed on the surface of the dielectric layer 13 using a vacuum vapor deposition method or the like.

Manufacturing the Back Panel

The back panel 20 is manufactured in the following way. The address electrodes 22 are formed by applying a paste for silver electrodes onto the back glass substrate 21 using a screen-printing method and baking the applied paste. Then, the dielectric layer 23 is formed by applying a paste containing $TiO_2$ particles and dielectric glass particles onto the display electrodes 22 using a screen-printing method and baking the applied paste. The barrier ribs 30 are formed by repeatedly applying a paste containing glass particles to the dielectric layer 23 with a certain pitch using the screen-printing method, then baking the applied paste.

The phosphor pastes of red, green, and blue are respectively made and applied to the spaces between the barrier ribs 24 using the screen-printing method. The phosphor layers 25 are formed by baking the applied pastes in air. The phosphor pastes of respective colors are produced by the following procedure.

The blue phosphor ($BaMgAl_{10}O_{17}$:Eu) is obtained through the following steps. First, the materials, barium carbonate ($BaCO_3$), magnesium carbonate ($MgCO_3$), and aluminum oxide ($\alpha$—$Al_2O_3$), are formulated into a mixture so that the ratio Ba:Mg:Al is 1:1:10 in the atoms. Next, a certain amount of europium oxide ($Eu_2O_3$) is added to the above mixture. Then, a proper amount of flax ($AlF_2$. $BaCl_2$) is mixed with this mixture in a ball mill. The obtained mixture is baked in a reducing atmosphere (in the presence of $H_2$ and $N_2$) at a temperature range of 1400° C. to 1650° C. for a certain time period (for example, 0.5 hours).

The red phosphor ($Y_2O_3$: Eu) is obtained through the following steps. First, a certain amount of europium oxide ($Eu_2O_3$) is added to yttrium hydroxide $Y_2(OH)_3$. Then, a proper amount of flax is mixed with this mixture in a ball mill. The obtained mixture is baked in air at a temperature range of 1200° C. to 1450° C. for a certain time period (for example, one hour).

The green phosphor ($Zn_2SiO_4$: Mn) is obtained through the following steps. First, the materials, zinc oxide (ZnO) and silicon oxide ($SiO_2$), are formulated into a mixture so that the ratio Zn:Si is 2:1 in the atoms. Next, a certain amount of manganese oxide. ($Mn_2O_3$) is added to the above mixture. Then, a proper amount of flax is mixed with this mixture in a ball mill. The obtained mixture is baked in air at a temperature range of 1200° C. to 1350° C. for a certain time period (for example, 0.5 hours).

The phosphors of the respective colors produced as above are then crushed and sifted so that the grains for the respective colors have ascertain particle size distribution. The phosphor pastes of the respective colors are obtained by mixing the grains with a binder and a solvent.

To form the phosphor layers 25, the above phosphor pastes are applied by screen-printing, though other methods may be used. For example, a method in which phosphor ink is spouted from a nozzle which is being scanned over the panel may be used. Alternatively, sheets of photosensitive resin including a phosphor may be produced, and attached to the surface of the back glass substrate 21 on which the barrier ribs 24 are arranged. The sheets are then patterned and exposed using photolithography to remove unnecessary components.

Sealing Front and Back Panels, Vacuum Exhausting and Introducing Discharge Gas

A paste of a sealing glass frit is applied to a peripheral region of one or both of the front panel 10 and the back panel 20 which have been manufactured as described above, and the applied paste is pre-baked so that resin and other elements are removed, forming a glass sealant layer. The front panel 10 and the back panel 20 are then put together with the display electrodes 12 and the address electrodes 22 facing each other at right angles. Both panels 10 and 20 are then heated, softening the glass sealant layer and sealing them together. As a result, an inner space (a space between the front panel 10 and the back panel 20, surrounded by the glass sealant layer) is sealed from the outside.

The sealing process described above will be explained in more detail later in this description. A shape of the glass sealant layer is set so that gaps to allow passage into and out of the inner space of the PDP are formed at the periphery of the PDP when the front panel 10 and the back panel 20 are put together. As the sealing process is carried out in a dry air atmosphere, a chance of the steam coming into contact with the phosphor layers is reduced. As a result, the heat deterioration in the blue phosphor layers can be reduced.

The panels sealed as described above are baked (for three hours at 350° C.) while air is being exhausted from the inner space between the sealed panels to produce a vacuum. The discharge gas with the above composition is introduced into the space at a certain pressure to complete the PDP.

Detailed Explanation of the Sealing Process

The glass sealant layer is formed without an uniform thickness on a peripheral region of one or both of the front panel 10 and the back panel 20, and is instead formed with gaps at the periphery of the PDP. The gaps allow passage into and out of the inner space when the front panel 10 and the back panel 20 are put together.

Figure 3A:
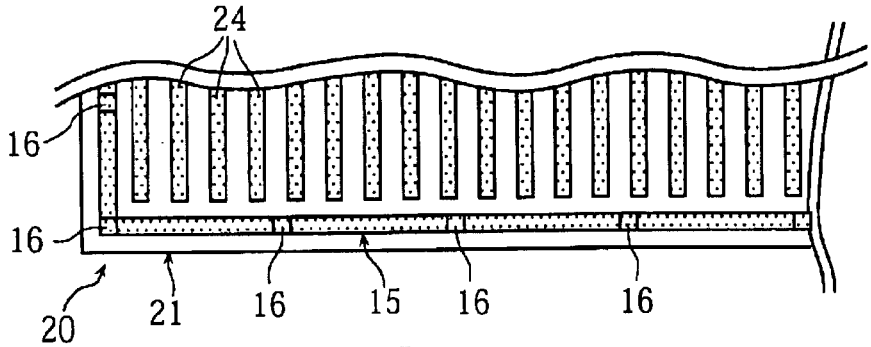
FIGS. 3 to 5 show specific examples of a shape of the glass sealant layer in the present embodiments.
Figure 3B:
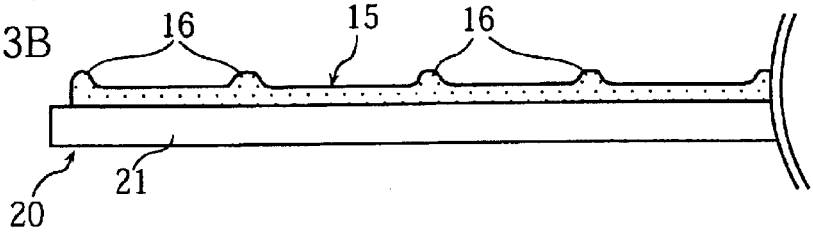
Figure 4A:
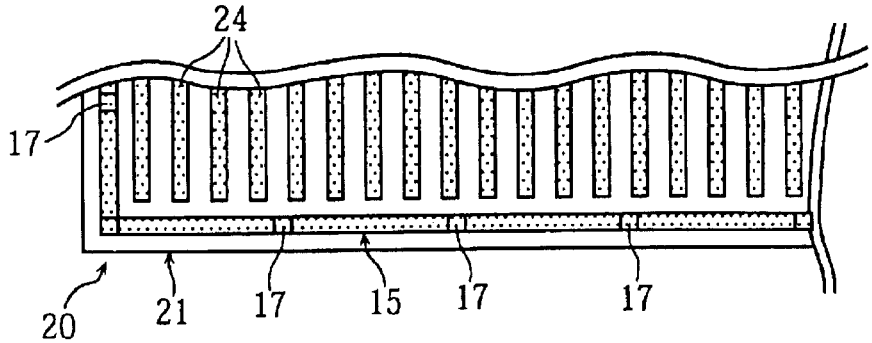
Figure 4B:
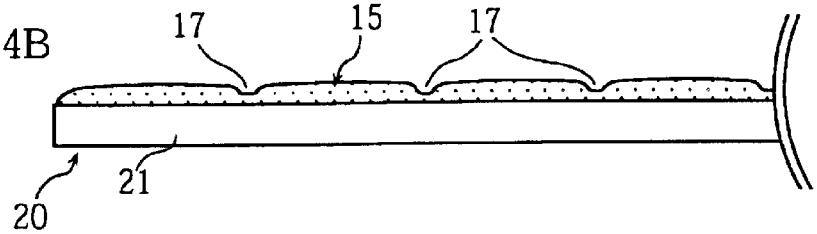

Specific examples of the glass sealant layer 15 are respectively shown in FIGS. 3 to 5. FIGS. 3A and 4A show top views and FIGS. 3B and 4B show side views.

In FIG. 3, a glass sealant layer 15 is provided on a periphery region of one panel (the back panel 20 in this figure). Protrusions 16 are formed in parts of the glass sealant layer 15 at certain intervals.

In FIG. 4, a glass sealant layer 15 is provided on a peripheral region of one panel (the back panel 20 in this figure). Depressions 17 are formed in parts of the glass sealant layer 15 at certain intervals.

Figure 5A:
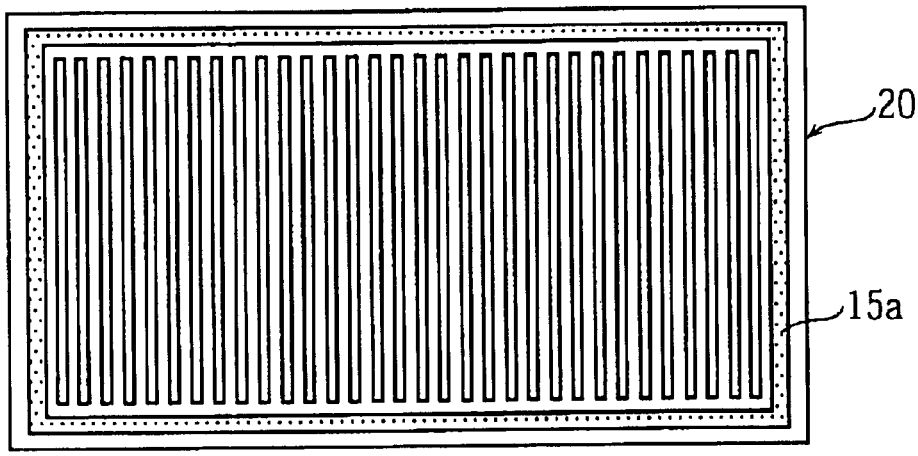
Figure 5B:
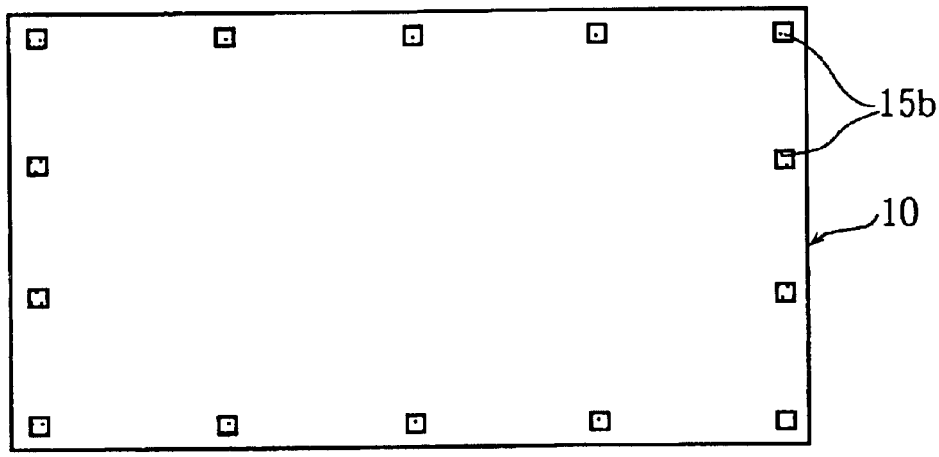

In FIG. 5A, a glass sealant layer 15*a* is formed on a peripheral region of a surface of one panel (the back panel 20 in this figure), with the thickness of the glass sealant layer 15*a* being uniform. In FIG. 5B, a glass sealant layer 15*b* is formed in insular pieces that are each positioned on a peripheral region of a surface of the other panel (the front panel 10 in this figure) at certain intervals.

Figure 6A:
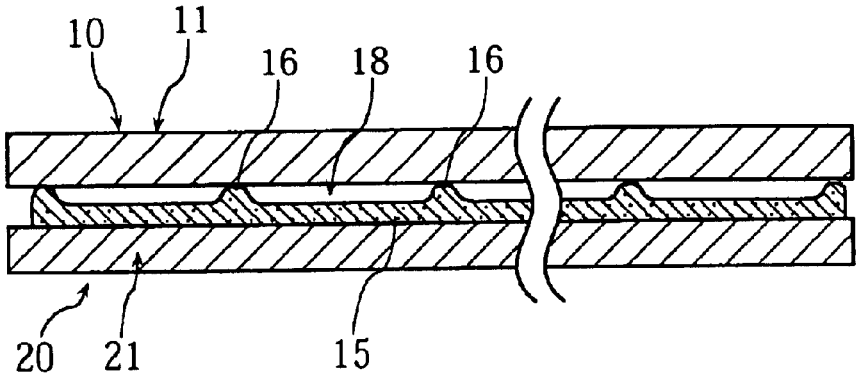
FIG. 6 shows simplified sectional views of the edges of the front panel 10 and the back panel 20 when the front panel 10 is placed on the back panel 20.
Figure 6B:
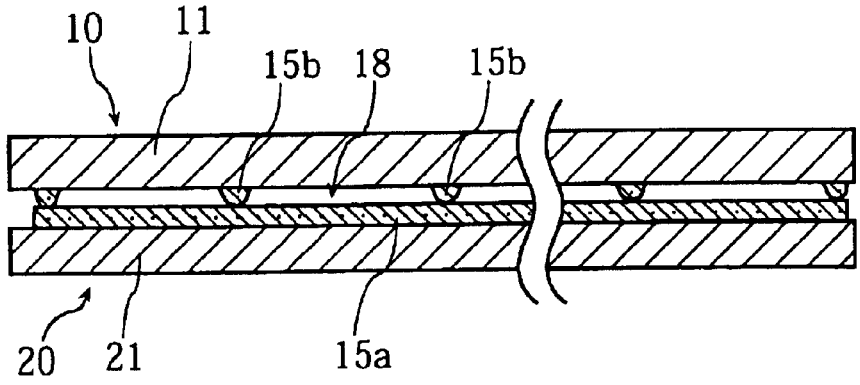

FIGS. 6A and 6B show simplified sectional views of the edges of the front panel 10 and the back panel 20 when the front panel 10 is placed on the back panel 20. FIG. 6A is an example shown in FIG. 3, and FIG. 6B is an example shown in FIG. 4. As can be seen from FIGS. 6A and 6B, gaps 18 are formed at the periphery of the PDP. The gaps 18 serve as passages between the inner space of the PDP and the outside of the PDP.

When the depressions 17 are formed in parts of the glass sealant layer 15 as shown in FIG. 4, the depressions 17 equate to the gaps, which serve as passages between the inner space of the panels 10 and 20 to the outside.

It should be noted that a conventional sealing glass frit with a softening point in a temperature range of 380° C. to 390° C. is used in the present embodiment.

A paste of the sealing glass frit is applied to a substrate by discharging a paste using a scanning dispenser that is typically used to apply an adhesive. However, screen-printing may also be used to apply the sealing glass frit paste.

When a dispenser is used to apply a paste of the sealing glass frit, the thickness of the paste can be adjusted by controlling a scanning speed of the dispenser or an amount of the paste being discharged. Therefore, the glass sealant layer 15 can easily be made with depressions or protrusions.

Furthermore, by applying layers of the paste to the substrate, the glass sealant layer 15 can be made with depressions or protrusions. For example, to form the glass sealant layer 15 shown in FIG. 3, a layer of the paste is first applied to the back panel 20 with a uniform thickness and dried, and then, another layer of the paste is applied only on the parts where the protrusions 16 are to be formed.

The following is an explanation of the sealing process in which panels 10 and 20 that have been placed facing each other with the glass sealant layer 15 in between as described above are heated and sealed. The panels are heated in dry air in a heating furnace, and are sealed when the temperature rises to a softening point of the glass with a low melting point or above.

Figure 7:
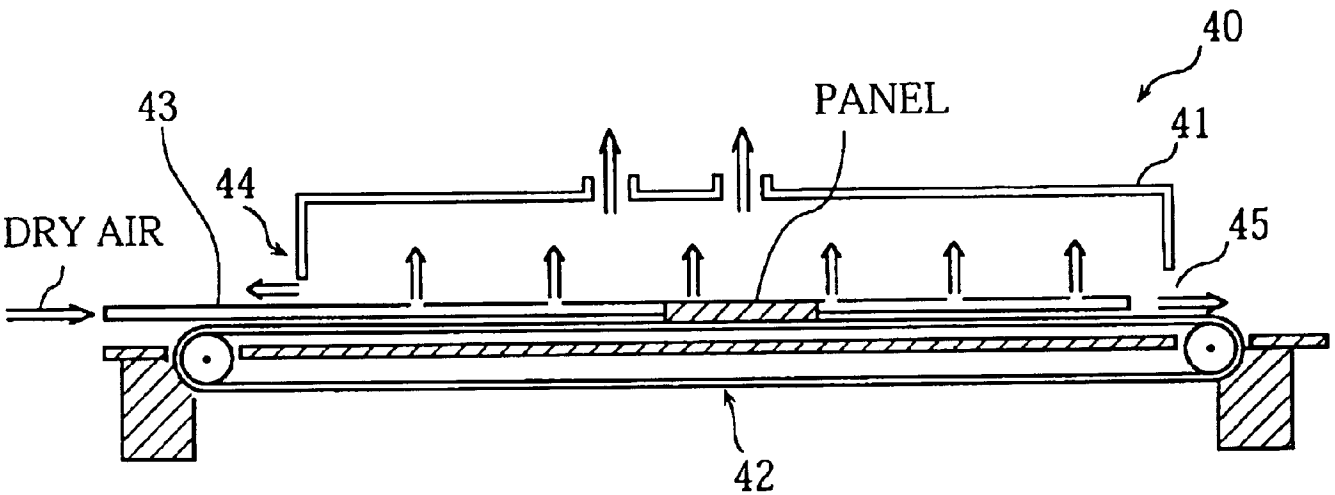
FIG. 7 shows the construction of a belt-conveyor-type heating apparatus used in the present embodiments.

FIG. 7 shows a typical construction of a belt-conveyor-type heating apparatus which is used in the heating and sealing process in the present embodiment.

The heating apparatus 40 includes a heating furnace 41 for heating the panels, a carrier belt 42 for carrying the panels to pass through the heating furnace 41, and a gas guiding pipe 43 for guiding an atmospheric gas into the heating furnace 41. A plurality of heaters (not illustrated) are provided in the heating furnace 41 along the heating belt.

The substrates are heated with a freely chosen temperature profile by adjusting the temperatures around the plurality of heaters placed between an entrance 44 and an exit 45. Also, the heating furnace can be filled with the atmospheric gas (dry air) injected through the gas guiding pipe 43.

The dry air used as the atmospheric gas is produced as follows. Air is made to pass through a gas dryer (not illustrated) which cools the air to a low temperature (minus tens ° C.), so that the amount (partial pressure) of steam contained in the cooled air is reduced, producing the dry air.

The front panel 10 and the back panel 20 having been put together are set on the carrier belt 42. Here, it is preferable that the front panel 10 and the back panel 20 are held using clamps or the like to prevent the panels that have been placed at a proper position from shifting.

The panels 10 and 20 that have been set are heated to a temperature higher than a softening point of the glass sealant layer 15 in the dry air atmosphere by passing through the heating furnace 51. As a result of this, the glass sealant layer 15 softens, resulting in the panels 10 and 20 being sealed together at their peripheries.

Effects Produced by the Sealing Method in the Present Embodiment

According to the sealing method of the present embodiment, the following effects can be obtained in comparison with a conventional method.

Normally, a gas such as steam is absorbed by the front panel 10 and the back panel 20. When these panels are heated to a high temperature, the absorbed gas is emitted. Especially at a temperature range of 200° C. to 250° C., moisture is emitted from the MgO protective layer (see-FIG. 14).

With a conventional manufacturing method, even though the gas absorbed by the panels is emitted during a process in which the glass sealant layer is pre-baked, the panels are left at a room temperature and again absorb gas before the sealing process. Therefore, gas absorbed by the front panel and the back panel is again emitted during the sealing process. As the inner space is sealed up with the surrounding glass sealant layer, the emitted gas is trapped within the inner space. It is known from measurement that the partial pressure of the steam in the inner space normally becomes 20 Torr or higher because of the above phenomenon.

The phosphor layers come into contact with the inner space and therefore are easily deteriorated by heat because of the influence of gas (especially steam emitted from the protective layer). When the phosphor layers (especially the blue phosphor layers) are deteriorated by heat, the light-emitting intensity decreases.

On the contrary, in the sealing process of the present embodiment, the glass sealant layer 15 is not deformed at a temperature below a softening point of the sealing glass 15 when the panels are heated. Therefore, gaps that have been formed between the peripheral regions of the front panel 10 and the back panel 20 to allow passages into and out of the inner space can be maintained. Accordingly, the gas (the steam) emitted within the inner space is released to the outside of the PDP through the gaps.

As a result, the heat deterioration in the blue phosphors during the sealing process can be reduced.

The present embodiment has an atmosphere of dry air inside the heating furnace 41, and so dry air drifts into the inner space through the gaps. Accordingly, the deterioration in the blue phosphors during the sealing process is more effectively decreased.

It is desirable that the partial pressure of the steam in the dry air inside the heating furnace is 10 Torr (1300 Pa) or lower, so that a sufficient effect to prevent the heat deterioration in the phosphors can be obtained. The above effects become more remarkable as the partial pressure of the steam is set at a lower value such as 5 Torr (650 Pa) or lower, or 1 Torr (130 Pa) or lower.

There is a certain relationship between the partial pressure of the steam and the dew-point temperature. Therefore, the partial pressure of the steam can be replaced with the dew-point temperature regarding the above description. That is, the lower the dew-point temperature is set, the greater the effect on reducing the deterioration of the phosphors by heat is. It is therefore desirable that the dew-point temperature of the dry gas is set at 12° C. or lower, 0° C. or lower, −20° C. or lower.

It should be noted that the glass sealant layer 15 is heated to a temperature of a softening point of the glass sealant layer 15 or higher during the sealing process, eventually eliminating the gaps. As a result, the front panel 10 and the back panel 20 are completely sealed up on their peripheries via the glass sealant layer 15.

The PDP manufactured in accordance with the method of the present embodiment has an effect of decreasing abnormal discharge when the PDP is driven since the phosphor layers contain a small amount of moisture.

Instead of forming gaps between the peripheral regions of the panels 10 and 20 during the sealing process, providing air vents at the corners of the panels 10 and 20 can also produce a certain effect of allowing moisture to be released from the inner space to the outside of the PDP. However, in accordance with the method in the present embodiment, gas can circulate between the inner space and the outside more effectively.

A similar effect can be obtained by sealing the panels 10 and 20 while forcibly injecting dry air from a chip tube into the inner space between the panels 10 and 20. However, according to the present embodiment, a device to inject dry air is not necessary during the sealing process, therefore, the effect to release moisture from the inner space to the outside of the PDP can be obtained more easily.

The following describes preferable shapes of the gaps formed at the periphery of the PDP to obtain a better effect.

The size of a gap (the height of the protrusion 16 or the depth of the depression 17) to effectively release moisture generated in the inner space to the outside of the panels should be at least 50 $\mu$m or 100 $\mu$m. To obtain a sufficient effect, it should be 300 $\mu$m or larger, and more preferably. 500 $\mu$m or larger.

Even if a ratio of the parts in which the gaps are formed in the sealant layer to the periphery of the sealant layer is small, a certain effect to release moisture from the inner space can be obtained. However, to make gas drift into the inner space from outside, it is preferable to set the ratio at least 50%.

As for the position where the gaps are formed, gaps formed closer to each other around one position can produce a certain effect to release a gas to the outside, however, gaps formed at different positions in the peripheral regions of the panels allow more passage of the gas from the inner space to the outside. In this case, the effect is expected to be more noticeable.

As described above, when the front panel 10 and the back panel 20 are sealed together, they are held with clamps or the like. This applies a pressure to the peripheries of the panels 10 and 20. The pressure applied to the glass sealant layer 15 is concentrated on the parts where gaps are not formed.

In view of applying the pressure uniformly onto the peripheries of the panels 10 and 20, it is preferable to provide the gaps around the peripheries rather than just at one position at the peripheries.

Study of Partial Pressure of Steam in Atmospheric Gas

It was confirmed by the following experiments that heat deterioration in the blue phosphors can be prevented by reducing the partial pressure of the steam in the atmospheric gas.

Figure 8:
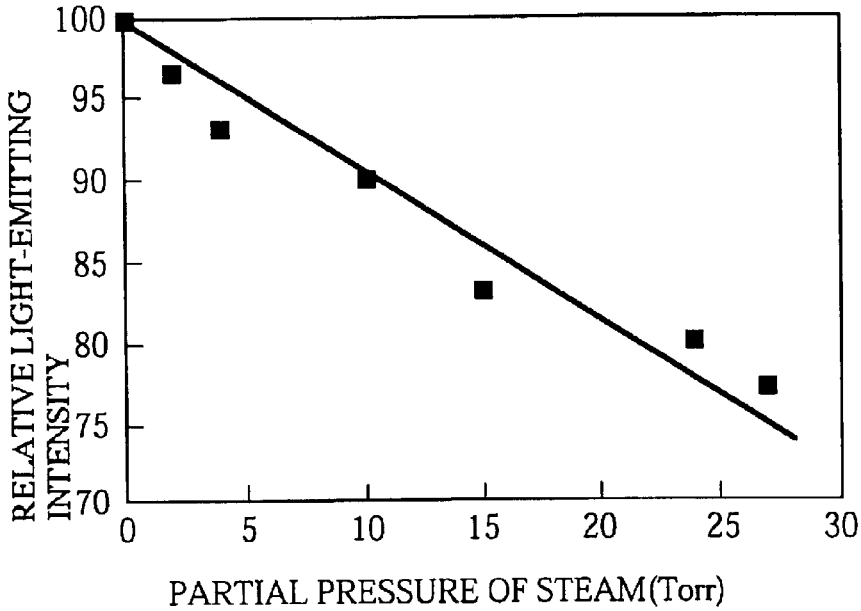
FIG. 8 shows measurement results of the relative intensity of light emitted from the blue phosphors when they are baked in the air containing the steam with different partial pressures.
Figure 9:
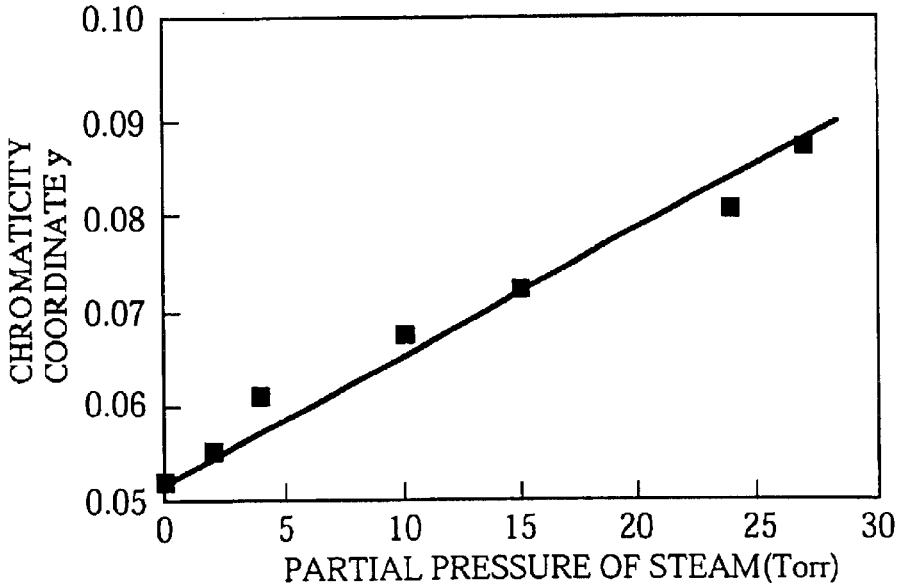
FIG. 9 shows measurement results of the chromaticity coordinate y of light emitted from the blue phosphors when they are baked in the air containing the steam with different partial pressures.

FIGS. 8 and 9 respectively show the relative intensity and the chromaticity coordinate y of the light emitted from the blue phosphors ($BaMgAl_{10}O_{17}$:Eu). These values were measured after the blue phosphors were baked in air by changing the partial pressure of the steam variously. The blue phosphors were baked with the peak temperature 450° C. maintained for 20 minutes.

The relative light-emitting intensity values shown in FIG. 8 are relative values calculated with the light-emitting intensity of the blue phosphors measured before baking being set to 100 as the standard value.

The light-emitting intensity can be calculated as follows. First, the emission spectrum of the phosphor layer is measured using a spectrophotometer. The chromaticity coordinate y is then calculated from the measured emission spectrum. The light-emitting intensity is obtained from a formula (light-emitting intensity=luminance/chromaticity coordinate y) using the calculated chromaticity coordinate y and a luminance measured beforehand.

Note that the chromaticity coordinate y of the blue phosphor before it was baked was 0.052.

It can be seen from the results shown in FIGS. 8 and 9 that no reduction of light-emitting intensity by heat or no change in the chromaticity was observed when the partial pressure of the steam was around 1 Torr (130 Pa), and a little change in the chromaticity was observed when the partial pressure of the steam was around 10 Torr (1300 Pa). However, it is noted that as the partial pressure of the steam increases, the relative light-emitting intensity of the blue phosphor decreases and the chromaticity coordinate y of the blue phosphor increases.

It has conventionally been thought that the light-emitting intensity reduces and the chromaticity coordinate y increases when the blue phosphor ($BaMgAl_{10}O_{17}$: Eu) is heated because the activating agent $Eu^{2+}$ ions are oxidized by heating and converted into $Eu^{3+}$ ions (J. Electrochem. Soc., Vol.145, No.11, November 1988). However, considering the fact that the chromaticity coordinate y of the above blue phosphor depends on the partial pressure of the steam in the atmosphere, it is thought that the $Eu^{2+}$ ions do not directly react with oxygen in the atmospheric gas (for example, air), but that the steam in the atmospheric gas accelerates the reaction related to the deterioration.

The light-emitting intensity and the chromaticity coordinate y of the blue phosphor ($BaMgAl_{10}O_{17}$: Eu) were measured when the blue phosphor was heated at various temperatures, for comparing the reduction rates of the light-emitting intensity and the changes in the chromaticity coordinate y. The measurement results show tendencies that reduction of the light-emitting intensity increases as the heating temperature becomes higher in the range of 300° C. to 600° C., and that reduction of the light-emitting intensity increases as the partial pressure of the steam becomes higher at any temperature. On the other hand, though the measurement results show the tendency that changes in the chromaticity coordinate y increases as the partial pressure of the steam becomes higher, the measurement results do not show the tendency that changes in the chromaticity coordinate y depends on the heating temperature.

Also, the amount of steam released when each of the following materials were heated was measured. The materials constitute the front glass substrate 11, the display electrodes 12, the dielectric layer 13, the protective layer 14, the back glass substrate 21, the address electrodes 22, the dielectric layer 23, the barrier ribs 24, and the phosphor layers 25. The measurement results indicate that MgO which is the material of the protective layer 14 releases the largest amount of steam. Therefore, it is assumed that the heat deterioration in the phosphor layers 25 during the sealing process is mainly caused by the steam released from the protective layer 14.

It should be noted that a basic explanation of the sealing process has been given in the present embodiment, however, the sealing process can further be elaborated as explained in the second to sixth embodiments.

Second Embodiment

In the present embodiment, when panels 10 and 20 that have been placed facing each other with a glass sealant layer 15 in between are heated and sealed, dry gas is spouted to sides of the panels, allowing the glass sealant layer 15 to be exposed to the dry gas.

Figure 10:
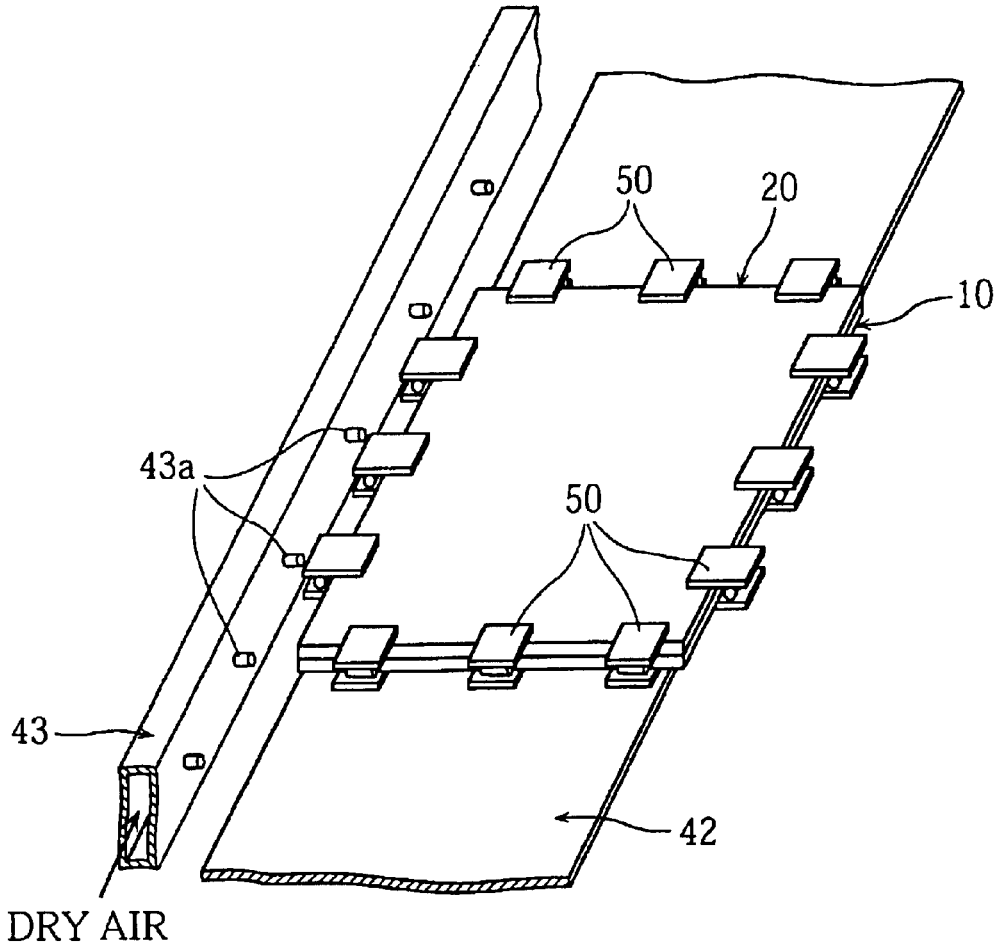
FIG. 10 shows how the front panel and the back panel are sealed in the heating apparatus according to the sealing method in the second embodiment.

FIG. 10 shows how the panels 10 and 20 are sealed in the heating apparatus in accordance with the manufacturing method in the present embodiment.

The heating apparatus is the same as the heating apparatus 40. The panels 10 and 20 that have been put together are placed on the carrier belt 42 along which the gas guiding pipe 43 is provided. A plurality of nozzles 43*a* are provided on the gas guiding pipe 43, so that gas is spouted from the nozzles 43*a* in a direction of the upper surface of the carrier belt 42.

The panels 10 and 20 having been set on the carrier belt 42 are carried through the heating furnace 51 while dry air is spouted from the nozzles 43*a* to the sides of the panels 10 and 20.

Here, as the dry gas is drifted into an inner space between the panels 10 and 20 through the gaps formed between the peripheral regions of the panels, moisture is efficiently released from the inner space to the outside. This results in a better effect to prevent heat deterioration in the blue phosphors in comparison with the first embodiment.

As shown in FIG. 10, the panels 10 and 20 are held at their peripheries using clamps 50 to prevent the panels from shifting.

Third Embodiment

The present embodiment describes a method to form a glass sealant layer 15 with an uniform width.

Firstly, the following explains a method to form partitions along the glass sealant layer 15.

Figure 11:
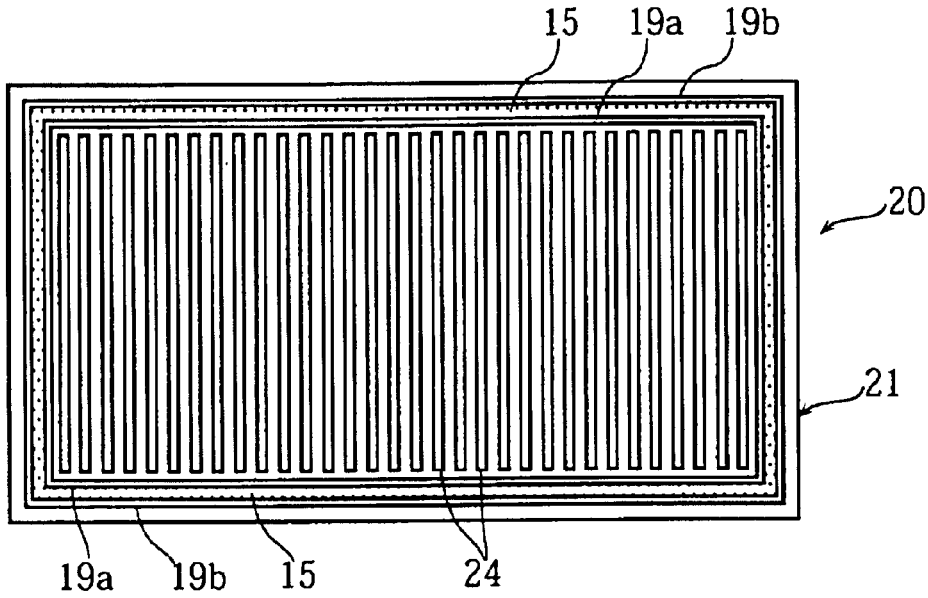
FIGS. 11 and 12 explain the sealing method in the third embodiment.

In an example shown in FIG. 11, a partition 19*a* and a partition 19*b* are respectively formed along the outer edge and the inner edge of the glass sealant layer 15 on the back glass substrate 21.

To form gaps in parts of the glass sealant layer 15, different amounts of the sealing glass are applied around the peripheral regions of the panels. This may easily make the width of the glass sealant layer vary when the panels are sealed. More specifically, the following tendency occurs when gaps are formed at the periphery of the PDP while the width of the glass sealant layer 15 is to be uniform. Parts of the glass sealant layer where the gaps are formed are to be thinner, therefore, a smaller amount of the sealing glass is applied to the parts of the sealant layer. Due to this, the width of the parts of the glass sealant layer where the gaps are formed tend to be narrower. It should be noted here that such a variety of the width of the glass sealant layer depends on the height of the gaps (that is, the height of the protrusion or the depth of the depression in the glass sealant layer 15). As one example, when the height of the gaps is around 500 $\mu$m, the width of the glass sealant layer varies by around 3 mm.

On the contrary, the partition 19*a* and the partition 19*b* formed as described above can prevent the softened sealing glass from flowing in the direction of the glass sealant layer. This prevents the width of the glass sealant layer from varying depending on parts when the panels are sealed.

FIG. 11 shows an example in which the glass sealant layer 15 and the partitions 19*a* and 19*b* are formed on the back glass substrate 21. However, one or both of the glass sealant layer 15 and the partitions 19*a* and 19*b* may be formed on the front glass substrate 11 to obtain the same effect.

The following describes a method to set parts of the glass sealant layer 15 where gaps are to be formed wider than parts where gaps are not to be formed before the glass sealant layer 15 softens.

Figure 12A:
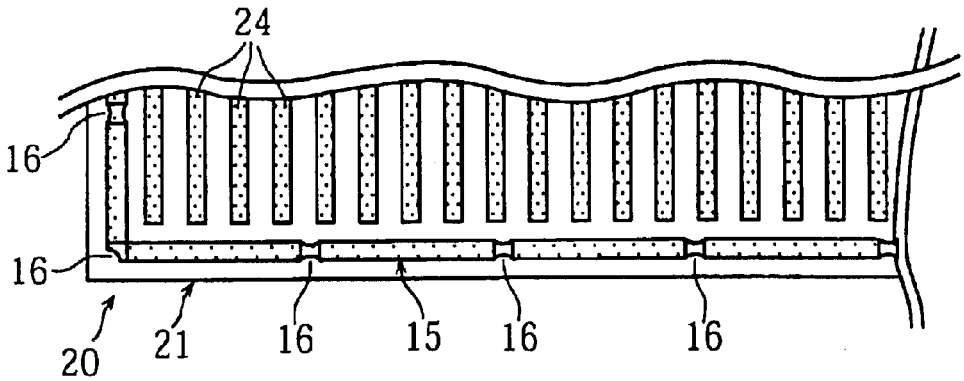
Figure 12B:
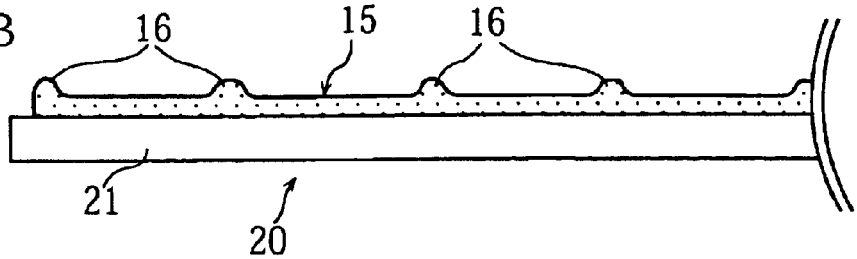

FIG. 12 shows an example that the protrusions 16 are formed in parts of the glass sealant layer 15 at certain intervals as shown in FIG. 3. The width of the parts in which the protrusions 16 are formed in the glass sealant layer 15 is set narrower than the other parts.

Adjusting the width of the glass sealant layer 15 as described above so that thicker parts are narrower results in a similar amount of the sealing glass being applied around the periphery of the panel. Accordingly, the width of the entire glass sealant layer 15 turns out to be uniform when the panels are sealed.

By making the width of the entire glass sealant layer 15 uniform as described above, the glass sealant layer 15 is prevented from flowing out to the display area and from deteriorating the display quality.

Fourth Embodiment

In the present embodiment, a sealant with a high softening point is used to form a glass sealant layer 15 so that an amount of moisture trapped within an inner space between panels is further decreased.

In the first embodiment, a glass with a low melting point having a softening point in a range of 380° C. to 390° C. is used as a sealant. On the contrary, a glass with a low melting point having a softening point of 410° C. or higher is used in the present embodiment.

By forming the glass sealant layer 15 from the sealant with a high softening point, gaps provided between the peripheries of the panels can be maintained until the panels are heated to a higher temperature, allowing more moisture to be released from the inner space to the outside. A larger amount of moisture is released from the inner space to the outside while the panels are being heated.

As described above, by using a sealant with a softening point of 410° C. or higher, gas is released from the inner space to the outside more effectively, making the effect to prevent the deterioration in the phosphor layers more noticeable.

Fifth Embodiment

In the present embodiment, to reduce an amount of moisture trapped in an inner space between panels, a peak temperature in a sealing process is lowered. This reduces a difference between a softening point of a glass sealant layer and the peak temperature.

Conventionally, the peak temperature in the sealing process is set at around 450° C. Assuming that a softening point of the sealing glass is in a range of 380° C. to 390° C. as above, the peak temperature is higher than the softening point of the sealing glass by 50° C. In this case, moisture emitted into the inner space with a rise in the temperature is trapped within the inner space after the gaps between the panels 10 and 20 have been eliminated, resulting in sealing the inner space from the outside. This causes heat deterioration in the phosphors. In contrast, even when a sealing glass with a softening point in a range of 380° C. to 390° C. equivalent to the conventional one is used, setting the peak temperature in the sealing process lower than a conventional case (for example, in a range of 410° C. to 420° C. and setting the difference between the softening point and the peak temperature smaller (in a range of 20° C. to 30° C. can reduce: the amount of moisture emitted into the inner space after the gaps between the panels 10 and 20 have been eliminated. This improves the effect to prevent the heat deterioration in the phosphors.

Sixth Embodiment

In the present embodiment, an amount of moisture trapped within an inner space between panels when the panels are heated and sealed is reduced. While the panels are being heated to a high temperature in the sealing process, the panels are kept at a temperature no lower than 250° C. but below a softening point of the glass sealant layer 15 for a certain period and then the panels are heated to a temperature higher than the softening point.

Here, it is assumed that the panels are heated at least for 10 minutes at a temperature no lower than 250° C. but below a softening point of the glass sealant layer 15.

Figure 13A:
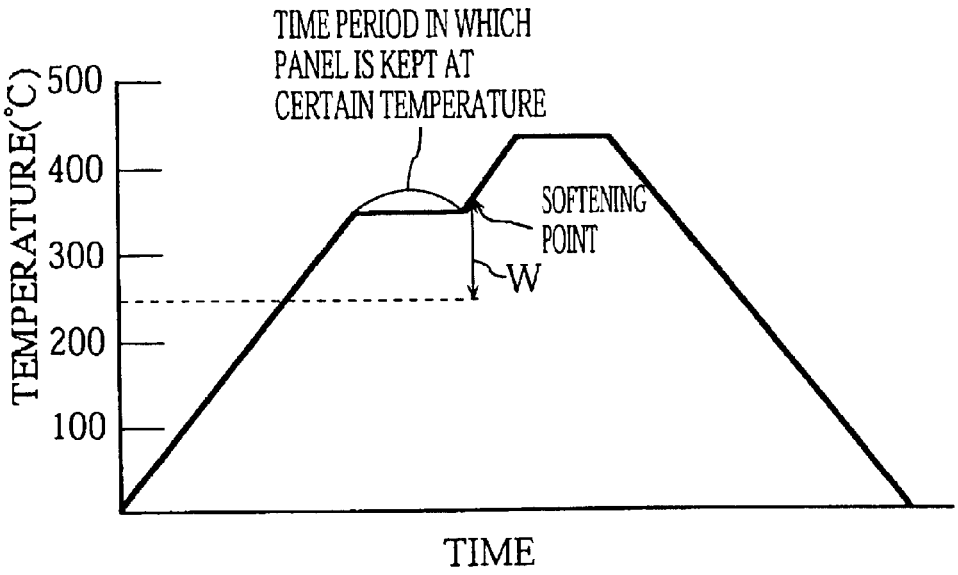
FIG. 13 shows ah example of the temperature profile in the sealing process in the sixth embodiment.
Figure 13B:
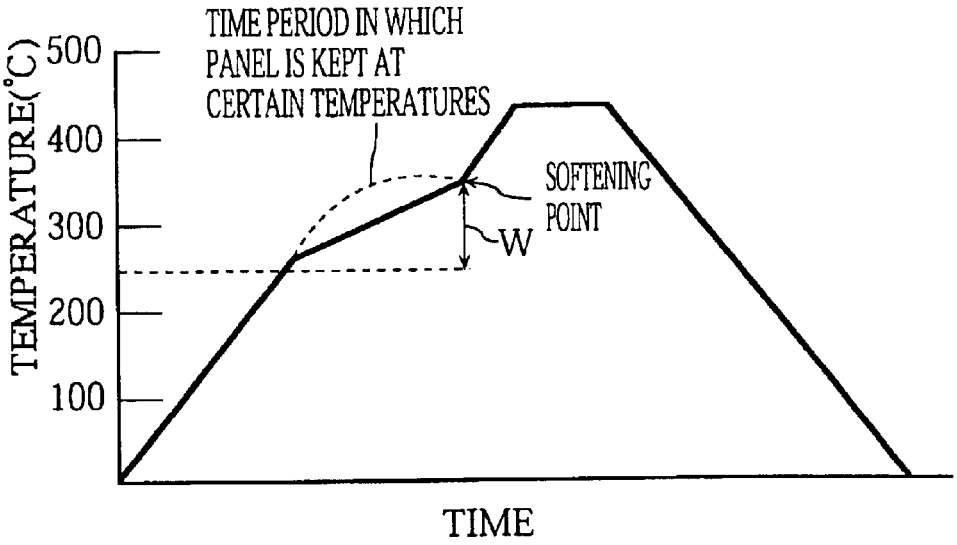

FIG. 13 is an example of a temperature profile in the sealing process in the present embodiment. FIG. 13A shows a case where the panels are maintained at a certain temperature in a range of 250° C. to the softening point of the glass sealant layer 15 (an arrow W in the figure) for a certain period. FIG. 13B shows a case where the panels are heated gradually from a temperature of 250° C. to the softening point of the glass sealant layer 15 in a certain period. In both the cases, the panels are maintained for at least 10 minutes in a temperature range of 250° C. to the softening point of the glass sealant layer 15.

The temperature range of 250° C. to the softening point of the glass sealant layer 15 is an optimum temperature range in which moisture can actively flow. Accordingly, moisture absorbed by the panels 10 and 20 (especially by the protective layer 14) can be emitted actively into the inner space and be released to the outside of the panels through the gaps. Therefore, by keeping the panels at a temperature in this optimum range, less moisture is absorbed by the panels 10 and 20 when the glass sealant layer 15 softens. Accordingly, less moisture is emitted to the inner space after the inner space has been sealed from the outside. This further improves the effect to prevent the heat deterioration in the phosphors.

The following experiments confirm that the absorbed moisture (especially, moisture absorbed by the protective layer) is emitted when the panels 10 and 20 are heated at a temperature of 250° C. or higher.

The amount of steam emitted from an MgO layer which is the same as the one used to form the front panel 10 is analyzed using the TDS (Thermal Desorption) analysis method.

Figure 14:
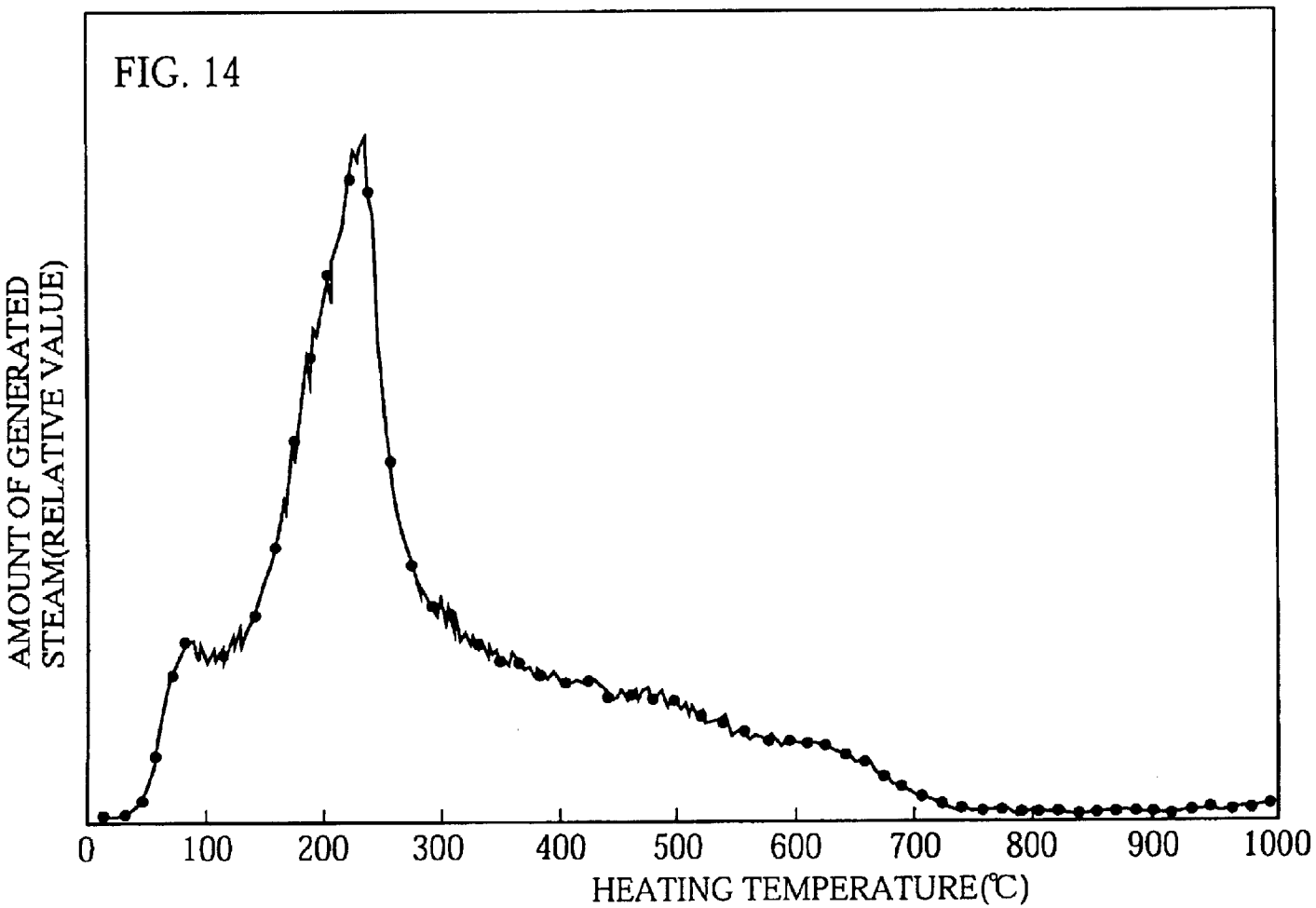
FIG. 14 is a graph showing analysis results of the amount of steam released when the MgO layer is heated.

The results are shown in FIG. 14. As can be seen from the figure, a large amount of steam is emitted when the MgO layer used in the PDP is heated at a temperature in a range of 200° C. to 250° C.

It should be noted that an effect to emit a larger amount of moisture can be obtained if the MgO layer is heated in the above temperature range for 30 minutes or longer.

Modifications

In the above embodiments, dry air is used as dry gas to form the atmosphere in the sealing process, however, it is possible to obtain a same effect by using inert gas such as nitrogen which does not react with the phosphor layers and whose partial pressure of the steam is low.

However, oxide phosphors, such as $BaMgAl_{10}O_{17}$: Eu, $Zn_2SiO$: Mn, and $(Y_2Gd)BO_3$: Eu, may cause defects like oxygen defects when heated in the atmosphere of non oxygen, decreasing the light-emitting efficiency. Therefore, it is preferable to use dry gas that contains oxygen in the sealing process.

In the above embodiments, a glass with a low melting point is used as a sealant to form the glass sealant layer 15, however, a same glass material as the barrier ribs 24 may instead be used as a sealant.

The same effect as in the above embodiments can be obtained by the following procedures. The glass sealant layer 15 is formed on one or both of the panels 10 and 20 using the same glass material as the barrier ribs so that it is formed as shown in any of FIGS. 3 to 5. The panels 10 and 20 are then placed facing each other with the glass sealant layer 15 in between, and are heated and sealed as the glass sealant layer 15 softens. It should be noted here that the glass material for the barrier ribs has a much higher softening point than the glass with a low melting point used in the above embodiments. Therefore, it is difficult to seal the panels by heating the glass for the barrier ribs in the heating furnace. The panels can be sealed using a laser radiation. By applying the laser radiation onto the front panel 10, the glass sealant layer 15 is intensively heated from the above and softens, resulting in the panels being sealed.

In case where the laser radiation is applied onto the periphery of the front panel 10, the phosphor layers are less likely to be exposed to a high temperature. However, the phosphor layers close to the periphery are heated. This produces a certain effect to release moisture generated in the inner space through the gaps when the panels are sealed from the outside, resulting in the same effect to prevent the heat deterioration in the phosphors.

The above embodiments explain the sealing process in dry air atmosphere. However, it is also preferable to conduct other processes, such as the baking process of the phosphors and the frit pre-baking process, in dry air atmosphere.

For example, in the baking process of the phosphors, the back glass substrate 21 on which the phosphor layers 25 are formed is baked using the heating apparatus 40 in dry air atmosphere (with the peak temperature 520° C. maintained for 10 minutes). In the frit pre-baking process, the front panel 10 or the back panel 20 on which the sealing glass frit is applied is baked using the heating apparatus 40 in dry air atmosphere (with the peak temperature 350° C. maintained for 30 minutes).

In this way, the heat deterioration in the phosphors that often occurs due to steam in the atmosphere during the baking process of the phosphor layers and the frit pre-baking process can be prevented by allowing dry gas to circulate while baking the phosphors. Here, the partial pressure of steam in the dry air is to be the same as explained in the sealing process.

In the above embodiments, the case of manufacturing a surface-discharge type PDP was described. However, the present invention can be applied to the case of manufacturing other types of PDP such as an opposed-discharge type PDP, as long as the manufacturing process of the PDP includes a sealing process in which the panels are sealed by heating a sealant layer therebetween.

EXAMPLE 1

TABLE 1

| PANEL NUMBER | HEIGHT OF PROTRUSION OR DEPTH OF CONCAVE (μm) | SOFTENING POINT OF SEALANT (° C.) | PEAK TEMPERATURE IN SEALING PROCESS(° C.) | MAINTAINED TEMPERATURE (° C.) | ATMOSPHERE IN SEALING PROCESS | PARTIAL PRESSURE OF STEAM CONTAINED IN DRY AIR(Pa) | RELATIVE LIGHT EMITTING INTENSITY OF BLUE LIGHT |
|---|---|---|---|---|---|---|---|
| 1 | 500 | 385 | 450 | NONE | DRY AIR | 130 | 110 |
| 2 | 500 | 385 | 450 | NONE | DRY AIR | 130 | 118 |
| 3 | 500 | 385 | 450 | NONE | DRY AIR | 130 | 120 |
| 4 | 500 | 385 | 450 | NONE | VACUUM | — | 103 |
| 5 | 50 | 385 | 450 | NONE | DRY AIR | 130 | 100 |
| 6 | 300 | 385 | 450 | NONE | DRY AIR | 130 | 111 |
| 7 | 1000 | 385 | 450 | NONE | DRY AIR | 130 | 122 |
| 8 | 500 | 385 | 450 | NONE | DRY AIR | 130 | 118 |
| 9 | 500 | 415 | 450 | NONE | DRY AIR | 130 | 133 |
| 10 | 500 | 385 | 410 | NONE | DRY AIR | 130 | 135 |
| 11 | 500 | 385 | 450 | 200 | DRY AIR | 130 | 127 |
| 12 | 500 | 385 | 450 | 300 | DRY AIR | 130 | 130 |
| 13 | 500 | 385 | 450 | 400 | DRY AIR | 130 | 119 |
| 14 | NONE | 385 | 450 | NONE | AIR | 1950 | 100 |

| PANEL NUMBER | CHROMATICITY COORDINATE y OF BLUE LIGHT | PEAK WAVELENGTH OF BLUE LIGHT EMITTION SPECTRUM (m) | COLOR TEMPERATURE ON WHITE BALANCE (K) | RATIO OF PEAK INTENSITY OF BLUE LIGHT EMITTION SPECTRUM TO THAT OF GREEN LIGHT EMITTION SPECTRUM (BLUE/GREEN) | PEAK NUMBER OF MOLECULES CONTAINED $NH_2O$ DESORBED FROM BLUE PHOSPHORS AT 200° C. OR HIGHER BY TOS ANALYSIS NUMBER) | RATIO OF c-AXIS LENGTH TO a-AXIS LENGTH(c/a) |
|---|---|---|---|---|---|---|
| 1 | 0.078 | 454 | 9000 | 0.9 | $1.0 \times 10^{16}$ | 4.0218 |
| 2 | 0.073 | 453 | 9200 | 1.01 | $8.0 \times 10^{15}$ | 4.0218 |

TABLE 1-continued

| | | | | | | |
|---|---|---|---|---|---|---|
| 3 | 0.071 | 451 | 9300 | 1.03 | $7.1 \times 10^{15}$ | 4.0217 |
| 4 | 0.071 | 451 | 7100 | 0.79 | $1.2 \times 10^{16}$ | 4.0219 |
| 5 | 0.089 | 456 | 6000 | 0.78 | $1.8 \times 10^{16}$ | 4.022 |
| 6 | 0.077 | 454 | 9000 | 0.92 | $9.0 \times 10^{15}$ | 4.0218 |
| 7 | 0.068 | 450 | 9500 | 1.05 | $6.2 \times 10^{15}$ | 4.0217 |
| 8 | 0.073 | 453 | 9200 | 1.02 | $7.5 \times 10^{15}$ | 4.0217 |
| 9 | 0.059 | 448 | 10600 | 1.15 | $2.7 \times 10^{15}$ | 4.0216 |
| 10 | 0.058 | 448 | 11000 | 1.15 | $2.0 \times 10^{15}$ | 4.0216 |
| 11 | 0.063 | 449 | 10000 | 1.1 | $4.0 \times 10^{15}$ | 4.0216 |
| 12 | 0.061 | 449 | 10200 | 1.13 | $3.2 \times 10^{15}$ | 4.0216 |
| 13 | 0.072 | 452 | 9300 | 1.01 | $8.0 \times 10^{15}$ | 4.0218 |
| 14 | 0.090 | 458 | 5800 | 0.76 | $2.0 \times 10^{16}$ | 4.022 |

PDPs of the panels 1 to 14 shown in Table 1 were manufactured. The size of each of the PDPs, the panels 1 to 14, is 42". The panel construction of each of the PDPs is the same, whose phosphor layers each being 30 $\mu$m thick, and the discharge gas, Ne (95%) and —Xe (5%) was introduced with the charging pressure of 500 Torr ($6.5\times10^4$ Pa).

The PDPs of the panels 1 to 13 were manufactured based on the above embodiments. A manufacturing process of each of the panels 1 to 13 included a common sealing process in which a glass sealant layer was formed so that gaps were provided between the peripheral regions of the panels 10 and 20. However, each of the panels 1 to 13 was slightly different in manufacturing process.

The panels 1 to 7 and the panels 9 to 13 each had a glass sealant layer with protrusions, the glass sealant layer formed on the peripheral region of the back glass substrate as shown in FIG. 3.

The glass sealant layer of the panel 1 had a protrusion at one corner of the panel. The glass sealant layer of the panel 2 had four protrusions respectively at four corners of the panel. The panels 3 to 7 and the panels 9 to 13 each had the glass sealant layer with protrusions in the peripheral region of the panel, the protrusions formed at intervals of about 10 cm. The length of each protrusion was set at around 6 mm. The height of each protrusion and the atmosphere in which panels were baked were set to various cases as shown in Table 1.

The panel 8 was made by forming a glass sealant layer on the peripheral region of the back glass substrate, and sealing the front and back panels together via the glass sealant layer. The glass sealant layer here had depressions each with a length of about 5 mm formed at intervals of about 10 cm as shown in FIG. 4.

The panel 14 was manufactured for comparison. The glass sealant layer was provided on the peripheral region of the back glass substrate before sealing the front and back panels so that no gap was formed therebetween.

A material for a sealant and a temperature profile for each panel is explained as follows.

The sealant of each panel is mainly composed of a glass with a low melting point that includes lead oxide (65 wt. % to 80 wt. %), boron oxide (10 wt. %), and titanium oxide (5 wt. % to 10 wt. %). A softening point of the sealant for each panel is either 410° C. or 385° C. The peak temperature of the temperature profile for each panel was set in accordance with a softening point of the sealant.

A glass with a low melting point having a softening point of 385° C. was used for the panels 1 to 8 and the panels 10 to 14, and a glass with a low melting point having a softening point of 415° C. was used for the panel 9. The peak temperature of the temperature profile during the sealing process for the panels 1 to 9 and the panels 11 to 14 was set at 450° C. As for the panels 11 to 13, they were maintained at respective temperatures shown in Table 1 (200° C., 300° C., and 400° C.) for 30 minutes while they were heated to a high temperature in the sealing process. Meanwhile, the peak temperature of the temperature profile during the sealing process of the panel 10 was set at 410° C.

It should be noted that the softening point of each sealant was adjusted by changing a ratio of lead oxide that was a main component of the sealant, or a ratio of other components in the sealant. The panels were kept at respective peak temperatures for 20 minutes.

As for the atmosphere in which the panels were baked, dry air atmosphere was used for the panels 1 to 3 and the panels 5 to 13, vacuum atmosphere for the panel 4, and air atmosphere with a partial pressure of the steam being 15 Torr (1950 Pa) for the panel 14.

Comparative Experiments

Comparison of Light-Emitting Characteristics

For each of the panels (PDPs) 1 to 14 manufactured as described above, the following were measured as the light-emitting characteristics.

(1) The light-emitting intensity, the chromaticity of emitted light, and the peak wavelength of the spectrum of emitted light when light is emitted from only blue cells.

(2) the color temperature in the white balance without color correction when light is emitted from all of the blue, red, and green cells to produce a white display on the same power condition.

(3) The ratio of the peak intensity of the spectrum of light emitted from the blue cells to that of the green cells when light is emitted from the blue cells and the green cells on the same power condition.

For determining the light-emitting intensity, the emission spectrum is first measured using a spectrophotometer. The chromaticity coordinate y is then calculated from the measured emission spectrum. The light-emitting intensity is obtained from a formula (light-emitting intensity=luminance chromaticity coordinate y) using the calculated chromaticity coordinate y and a luminance measured in advance.

The measurement results of the above experiments are shown in Table 1.

It should be noted that relative values calculated with the light intensity of the panel 14 (comparative example) being set to 100 as the standard value were used to express the light-emitting intensity of the blue cells shown in Table 1.

Figure 15:
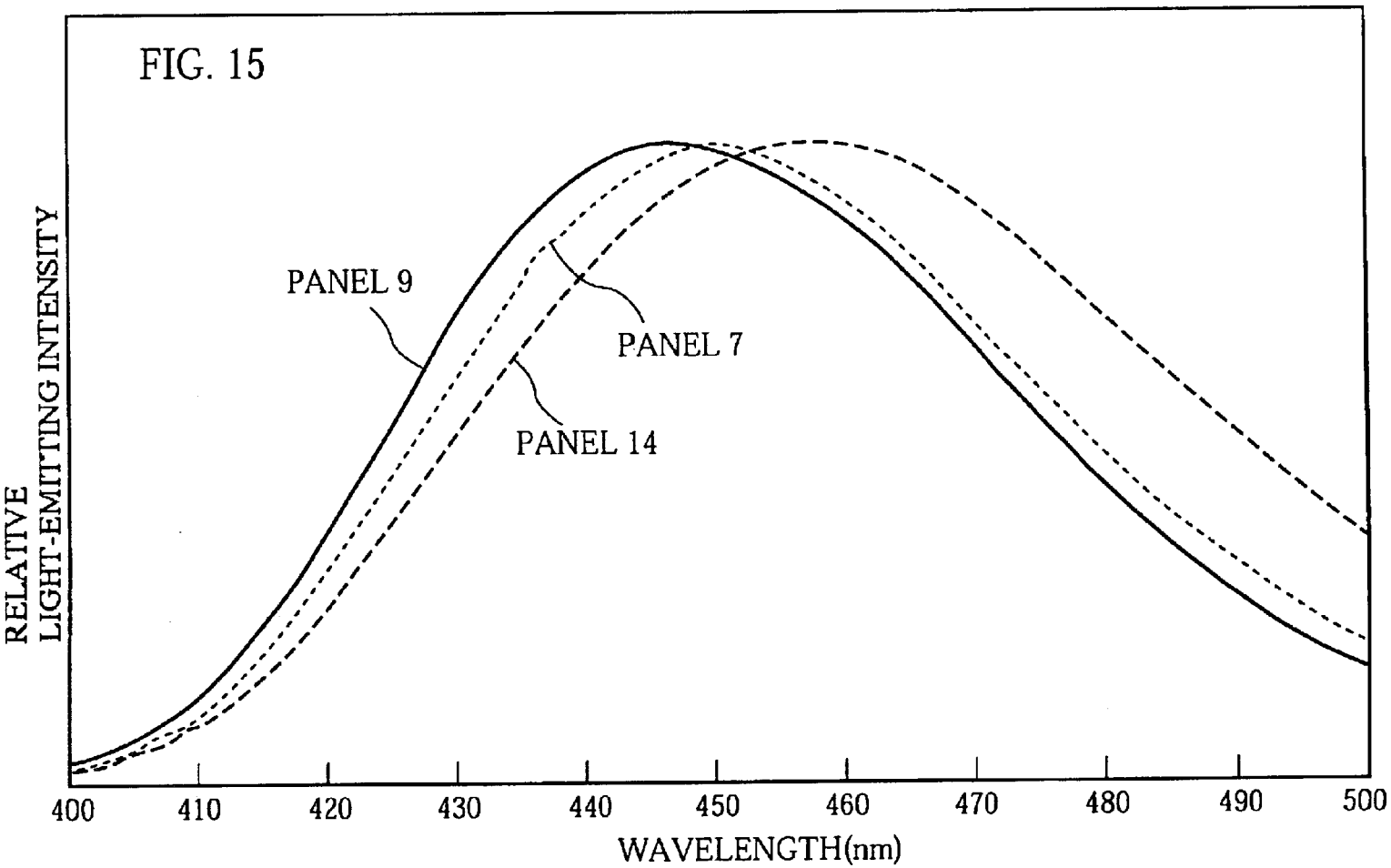
FIG. 15 shows spectrums of light emitted from blue cells when only the blue cells emit light in the PDPs of the present embodiments and in the PDP of the comparative example.
Figure 16:
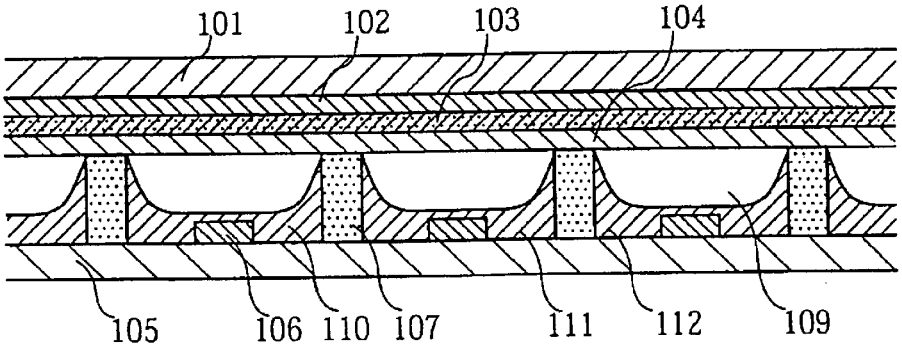
FIG.16 PRIOR ART
FIG. 16 is a simplified sectional view showing an example of a typical AC-type PDP.

FIG. 15 shows the emission spectrum of the panels 7, 9, and 14 when only the blue cells emit light.

Study of Light-Emitting Characteristics

According to the measurement results shown in Table 1, the panels 1 to 13 of the present embodiments are superior to the panel 14 of the comparative example in the light-emitting characteristics (that is, the panels 1 to 13 have higher panel luminance and color temperatures).

Moreover, because the panels 1 to 13 of the present embodiments are provided with the gaps at the peripheries of the panels, the partial pressure of the steam of the air circulating in the panels 1 to 13 is lower than the panel 14. Therefore, less moisture is trapped within the inner space of the panels 1 to 13 of the present embodiments after the sealant has softened. As a result, the heat deterioration in the blue phosphor layers is reduced.

In comparing the light-emitting characteristics of the panels 1, 2, and 3, better results are shown in the order of the panels 1, 2, and 3. This implies the following phenomenon. As the number of protrusions formed on the glass sealant layer increases, the relative light-emitting intensity improves further, the chromaticity of emitted light becomes smaller, and the peak wavelength of the emission spectrum becomes shorter. That is, the light-emitting characteristics are improved further.

The reason for the above phenomenon can be considered as follows. When only a small number of the protrusions are provided, the glass substrates bulge naturally so that smaller gaps are formed on their peripheral regions. It is difficult to exhaust the steam generated in the inner space effectively through these smaller gaps.

In comparing the light-emitting characteristics of the panels 3 and 8, the panel 3 is superior to the panel 8. The reason can be considered that the length of the gaps formed at the periphery of the panel 3 having the protrusions in parts of the glass sealant layer is longer than that of the gaps formed at the periphery of the panel 8 having the depressions in parts of the glass sealant layer. As a result, the steam generated in the inner space of the panel 3 can be released to the outside more effectively than the panel 8.

In comparing the light-emitting characteristics of the panels 3, 5, 6, and 7, better results are shown in order of the panels 5, 3, 6, and 7. The reason can be considered that the steam generated in the inner space can be exhausted more effectively as the height of the protrusions formed on the glass sealant layer becomes higher (the size of the gaps formed between the front and back panels becomes larger).

It is noted that the light-emitting characteristics of the panel 5 are no less different from those of the panel 14 of the comparative example. This indicates that the height of the protrusions formed in parts of the glass sealant layer (the size of the gaps) should be set at 100 $\mu$m or larger to obtain a sufficient effect.

In comparing the light-emitting characteristics of the panels 3 and 9, the panel 9 is superior. The reason can be considered that the gaps are maintained at a higher temperature as the sealant with a higher softening point is used. Therefore, a larger amount of steam emitted to the inner space can be released to the outside, resulting in reduction of the heat deterioration in the blue fluorescent layers.

In comparing the light-emitting characteristics of the panels 3 and 10, the panel 10 is superior. This indicates, when the sealant with the same softening point is used, the light-emitting characteristics of the panel are improved further as the peak temperature during the sealing process is lower.

The reason of the above phenomenon can be considered that the amount of the steam emitted into the inner space at a temperature above a softening point of the sealant is reduced by setting the peak temperature lower during the sealing process. As a result, the heat deterioration in the blue phosphors is reduced.

In comparing the light-emitting characteristics of the panels 3 and 4, the panel 4 is inferior. The reason can be considered that the panel 4 is heated in a vacuum atmosphere, and the blue phosphors that are oxide phosphors cause oxygen defects as some oxygen is desorbed from the oxide phosphors when heated in the atmosphere of non oxygen.

In comparing the light-emitting characteristics of the panels 3, 11, and 12, better results are shown in order of the panels 3, 11, and 12. The reason can be considered as follows. In case where a temperature at which the panels are maintained for a certain period is equal to or lower than a softening point of the sealant (380° C.), larger amount of steam absorbed by the substrates (especially by the MgO layer) is released to the outside as the panels are kept at higher temperature.

The light-emitting characteristics of the panel 13 are inferior to those of the panels 3, 11, and 12. The reason can be considered that when the panel is maintained at a temperature that is equal to or higher than a softening point of the sealant (380° C.) for a certain period, a larger amount of steam absorbed by the substrates (especially by the MgO layer) is emitted to the sealed inner space, resulting in the heat deterioration in the blue phosphors.

By focusing attention on the relationships between the chromaticity coordinate y of the emitted blue light and the peak wavelength of the emitted blue light for each panel provided in Table 1, it is noted that the peak wavelength of the emitted blue light is shorter as the chromaticity coordinate y of the emitted blue light is lower. This shows that a low chromaticity coordinate y of the emitted blue light has a same effect as a short peak wavelength of the emitted blue light.

Analysis of the Blue Phosphors

The blue phosphors were taken out from each of the panels 1 to 14, and the number of molecules contained in one gram of $H_2O$ gas desorbed from the blue phosphors was measured using the TDS (Thermal Desorption) analysis method. Also, a-axis length and c-axis length of the blue phosphor crystal were measured using the X-ray analysis.

The TDS analysis was conducted by the following steps, using the infrared heating-type thermal desorption analysis apparatus manufactured by ULVAC CORPORATION.

A plate made of Ta was filled with phosphors and was evacuated to the pressure of $10^{-4}$ Pa order in a preliminary exhaust hood, and was placed in a measurement room and depressurized to $10^{-7}$ Pa order. Following this, the phosphors were heated using an infrared heater from a room temperature to 1100° C. at a speed of 10° C./min. The number of molecules contained in $H_2O$ (mas number 18) desorbed from the blue phosphors was measured at every 15 seconds in scanning mode.

The measurement results are shown in Table 1.

Study of Analysis Results of Blue Phosphors

The measurement results show that the number of molecules contained in one gram of $H_2O$ desorbed from the blue phosphors of each of the panels (PDPs) 1 to 13 of the present embodiments is $1\times10^{16}$ or smaller at its peak, and the ratio of c-axis length to a-axis length is 4.0218 or smaller. On the contrary, the measurement results show that both the number of molecules and the ratio of c-axis length to a-axis length for the blue phosphors of the panel 14 of the comparative example are larger than the panels 1 to 13 of the present embodiments.

INDUSTRIAL USE POSSIBILITY

The PDP of the present invention and the method of producing the PDP are effective for manufacturing displays for computers or TVS, especially for manufacturing large-screen displays.

What is claimed is:

1. In a plasma display panel manufacturing method for providing an improved plasma display pane with cells of phosphor layers including a blue phosphor layer with an improved chromaticity coordinate, the improvement comprising the steps of:

forming a sealant layer, about a peripheral region of main surfaces of a front panel and a back panel facing each other to provide cells of phosphor layers, the sealant layer is arranged in contact with both the periphery of the front panel and back panel to provide a plurality of spaced open gaps about the periphery to provide egress to an open space containing the cells between the facing front panel and back panel;

circulating a dry gas, wherein a partial pressure of steam included in the dry gas atmosphere is 130 Pa or lower, through the spaced open gaps to remove any absorbed gases from the manufacturing of the front panel and back panel;

initially heating the entire facing front panel and back panel to release the absorbed gases while circulating the dry gas through the spaced open gaps;

continuing the heating of the entire facing front panel and back panel at a temperature to soften the sealant layer sufficiently to gradually close the spaced open gaps while maintaining the circulation of the dry gas until the peripheral region is sealed wherein the chromaticity coordinate, y, in the CIE color specification of luminescent color of light emitted from only cells including the blue phosphor layer is 0.08 or lower; and moving the facing front and back panels with the sealant open gaps through an oven while directing dry gas through nozzles toward side peripheral regions including the spaced gaps as the spaced gaps are gradually closed by an application of pressure.

2. The plasma display panel manufacturing method of claim 1, wherein in the sealant layer forming step, the sealant layer is formed with either plural protrusions or plural depressions in at least one part of the sealant layer formed at predetermined intervals on the at least one of the peripheral regions of the panels to provide the spaced open gaps.

3. The plasma display panel manufacturing method of claim 1, wherein the height of the opening gap between the front and back panel is greater than 300 $\mu$m.

4. The plasma display panel manufacturing method of claim 1, wherein the initial heating temperature is approximately 250° C. and the continuing heating temperature is approximately 410° C. or higher to soften the sealant layer.

5. The plasma display panel manufacturing method of claim 1, wherein the circulating of dry gas occurs within the oven and the nozzles direct the dry gas to provide an unrestricted flow of dry gas towards the spaced open gaps in a peripheral region of the front panel and back panel.

6. The plasma display panel manufacturing method of claim 5 wherein the ratio of an initial forming of the spaced gaps along the peripheral region to the remaining sealant layer contacting the front and back panels is 50%.

7. A plasma display panel sealing apparatus for sealing a front panel and a back panel that have been placed facing each other with a sealant layer between outer regions of the panels by heating the panels and the sealant layer, the sealing layer is positioned between a periphery of the front panel and the back panel to provide gaps, comprising, a gas circulating unit for directing heating gas to the gaps on the peripheral sides of the panels so as to circulate the heating gas through the gaps from the outer regions of the panels to an inner space between the panels and to release the heating gas through the gaps.

* * * * *